US008961244B2

(12) United States Patent
Nagasawa

(10) Patent No.: US 8,961,244 B2
(45) Date of Patent: Feb. 24, 2015

(54) TERMINAL FITTING AND BULB SOCKET

(71) Applicant: Yazaki Corporation, Tokyo (JP)

(72) Inventor: Masanori Nagasawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 82 days.

(21) Appl. No.: 13/757,938

(22) Filed: Feb. 4, 2013

(65) Prior Publication Data

US 2013/0210253 A1 Aug. 15, 2013

(30) Foreign Application Priority Data

Feb. 10, 2012 (JP) ..... 2012-026869

(51) Int. Cl.

| | |
|---|---|
| ***H01R 4/24*** | (2006.01) |
| ***H01R 13/11*** | (2006.01) |
| ***H01R 13/24*** | (2006.01) |
| ***H01R 33/46*** | (2006.01) |

(52) U.S. Cl.

CPC ..... *H01R 13/11* (2013.01); *H01R 13/2428* (2013.01); *H01R 33/46* (2013.01)

USPC ..... 439/700; 439/824

(58) Field of Classification Search

USPC ..... 439/700, 824

See application file for complete search history.

(56) References Cited

U.S. PATENT DOCUMENTS

| | | | | |
|---|---|---|---|---|
| 4,773,877 | A * | 9/1988 | Kruger et al. | 439/482 |
| 5,967,856 | A * | 10/1999 | Meller | 439/700 |
| 6,358,097 | B1 * | 3/2002 | Peters | 439/700 |
| 6,402,567 | B1 * | 6/2002 | Zhu | 439/700 |
| 6,524,140 | B2 * | 2/2003 | Takagi et al. | 439/700 |
| 6,626,708 | B2 * | 9/2003 | Phillips | 439/700 |
| 7,226,293 | B2 * | 6/2007 | Na et al. | 439/66 |
| 7,322,834 | B2 * | 1/2008 | Hu et al. | 439/83 |
| 7,445,518 | B2 * | 11/2008 | Schneider nee Hild et al. | 439/700 |
| 7,585,192 | B1 * | 9/2009 | Lai | 439/700 |
| 8,734,193 | B2 * | 5/2014 | Tokuhara et al. | 439/824 |
| 2005/0064766 | A1 * | 3/2005 | Zhang et al. | 439/700 |
| 2005/0070170 | A1 * | 3/2005 | Zhang et al. | 439/700 |
| 2007/0093145 | A1 * | 4/2007 | Wei | 439/824 |

FOREIGN PATENT DOCUMENTS

| | | |
|---|---|---|
| JP | 10-92538 A | 4/1998 |

* cited by examiner

*Primary Examiner* — Gary Paumen

(74) *Attorney, Agent, or Firm* — Sughrue Mion, PLLC

(57) ABSTRACT

A bulb socket includes a socket body in which a bulb is mounted, an earth terminal, a pair of terminal fittings for making elastic contact with a contact point of the bulb, and packing 6 with which a gap between the socket body and an attachment part of the socket body is sealed. One end of the socket body is provided with a mounting port of the bulb. The earth terminal and the terminal fittings are attached to the inside of the mounting port. The terminal fitting includes a body, a leg part linearly extending from one end of the body, and a spring part extending from the other end of the body in a meandering shape. The spring part includes four bent parts. Bending angles of the bent parts are equal.

4 Claims, 7 Drawing Sheets

TERMINAL FITTING AND BULB SOCKET

BACKGROUND OF THE INVENTION

The present invention relates to a terminal fitting which is attached to a bulb socket and makes elastic contact with a contact point of a bulb mounted in the bulb socket.

This kind of terminal fitting is disclosed in the following Patent Reference 1. In the terminal fitting of Patent Reference 1, a spring part extends in a meandering shape from a base part fixed to a socket body and the spring part makes elastic contact with a contact point of a bulb.

CITATION LIST

[Patent Reference 1] JP-A-10-92538

The terminal fitting described above had a fear of degrading spring performance of the spring part with use since a bent part of the spring part flexes in the case of making elastic contact with the contact point of the bulb. Also, there was a fear of adversely affecting continuity performance by displacing a position of contact between the spring part and the contact point of the bulb resulting from deformation of the bent part.

SUMMARY

The invention has been implemented in view of such problems, and an object of the invention is to provide a terminal fitting and a bulb socket capable of solving the problems described above.

According to one aspect of the present invention, there is provided a terminal fitting which is attached to a bulb socket and makes elastic contact with a contact point of a bulb mounted in the bulb socket, including a spring part for making elastic contact with the contact point, wherein the spring part is formed in a meandering shape including at least four bent parts and extending from a contact part making contact with the contact point.

Each of the bent parts may be bent at an equal angle.

The contact part may include a folded part formed by folding a side of the bent part beyond a portion making contact with the contact point so that the contact part makes perpendicular contact with the contact point.

DETAILED DESCRIPTION OF EMBODIMENTS

One embodiment of the invention will hereinafter be described with reference to the drawings.

Figure 1:
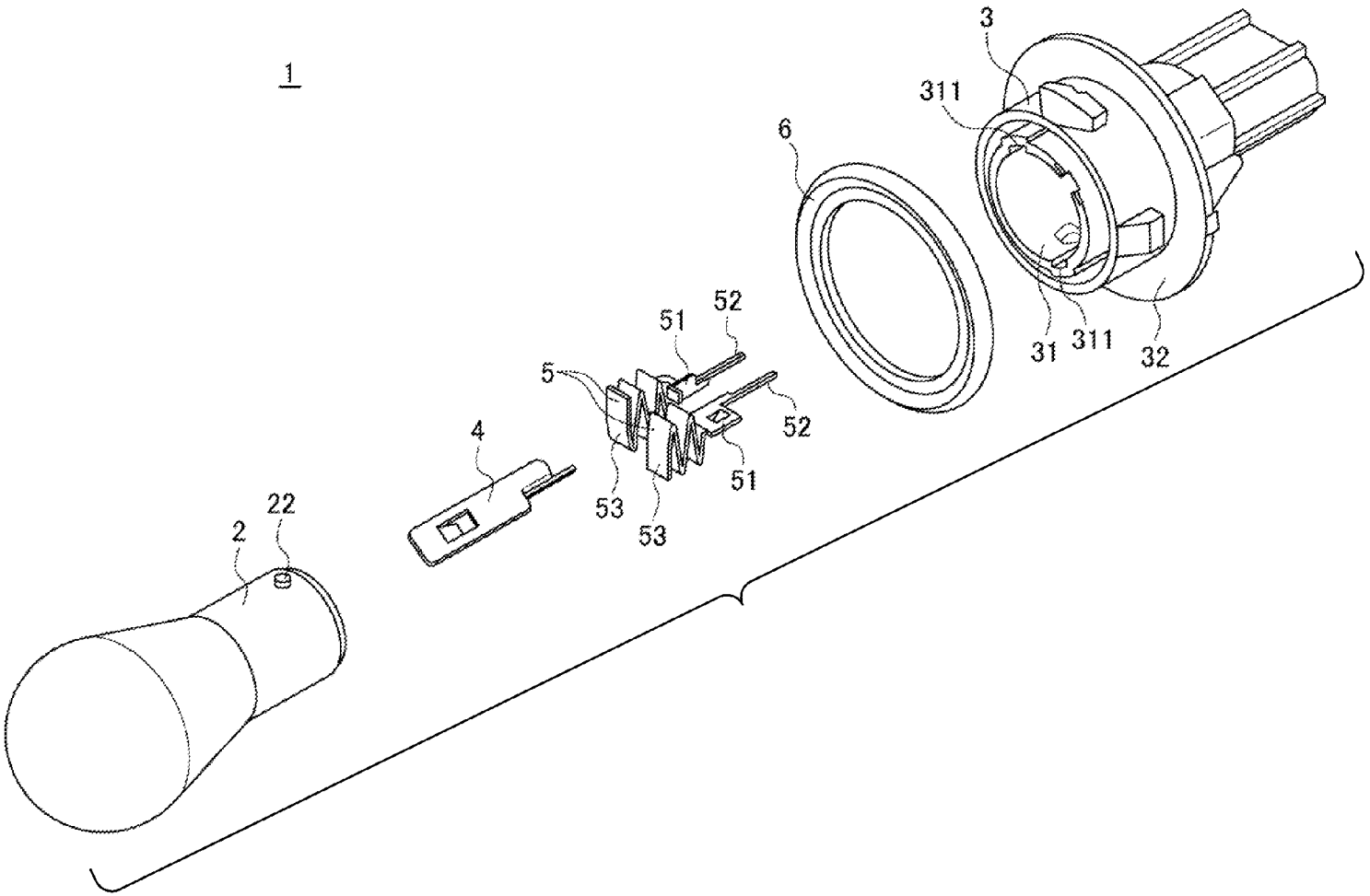
FIG. 1 is an exploded perspective view showing a bulb socket of one embodiment of the invention.

A bulb socket 1 shown in FIG. 1 includes a socket body 3 in which a bulb 2 is mounted, an earth terminal 4, a pair of terminal fittings 5 for making elastic contact with a contact point 21 of the bulb 2, and packing 6 with which a gap between the socket body 3 and an attachment part of the socket body 3 is sealed. An outer peripheral surface of a mounting part of the bulb 2 to the socket body 3 is provided with a protrusion 22.

One end of the socket body 3 is provided with a mounting port 31 of the bulb 2 and the other end of the socket body 3 is provided with a connection 34 (see FIGS. 4A to 4C) of a connector, respectively. The earth terminal 4 and the terminal fittings 5 are attached to the inside of the mounting port 31. The inside of the mounting port 31 is provided with a guide groove 311 for guiding the protrusion 22 of the bulb 2, and a lock groove 312 (see FIGS. 4A to 4C) communicating with the guide groove 311. The mounting port 31 communicates with the connection 34 through an insertion hole 33 (see FIGS. 4A to 4C).

The packing 6 is mounted on an outer peripheral surface of the socket body 3, and is interposed between the attachment part of the socket body 3 and a flange part 32 formed on the outer peripheral surface of the socket body 3.

Figure 2:
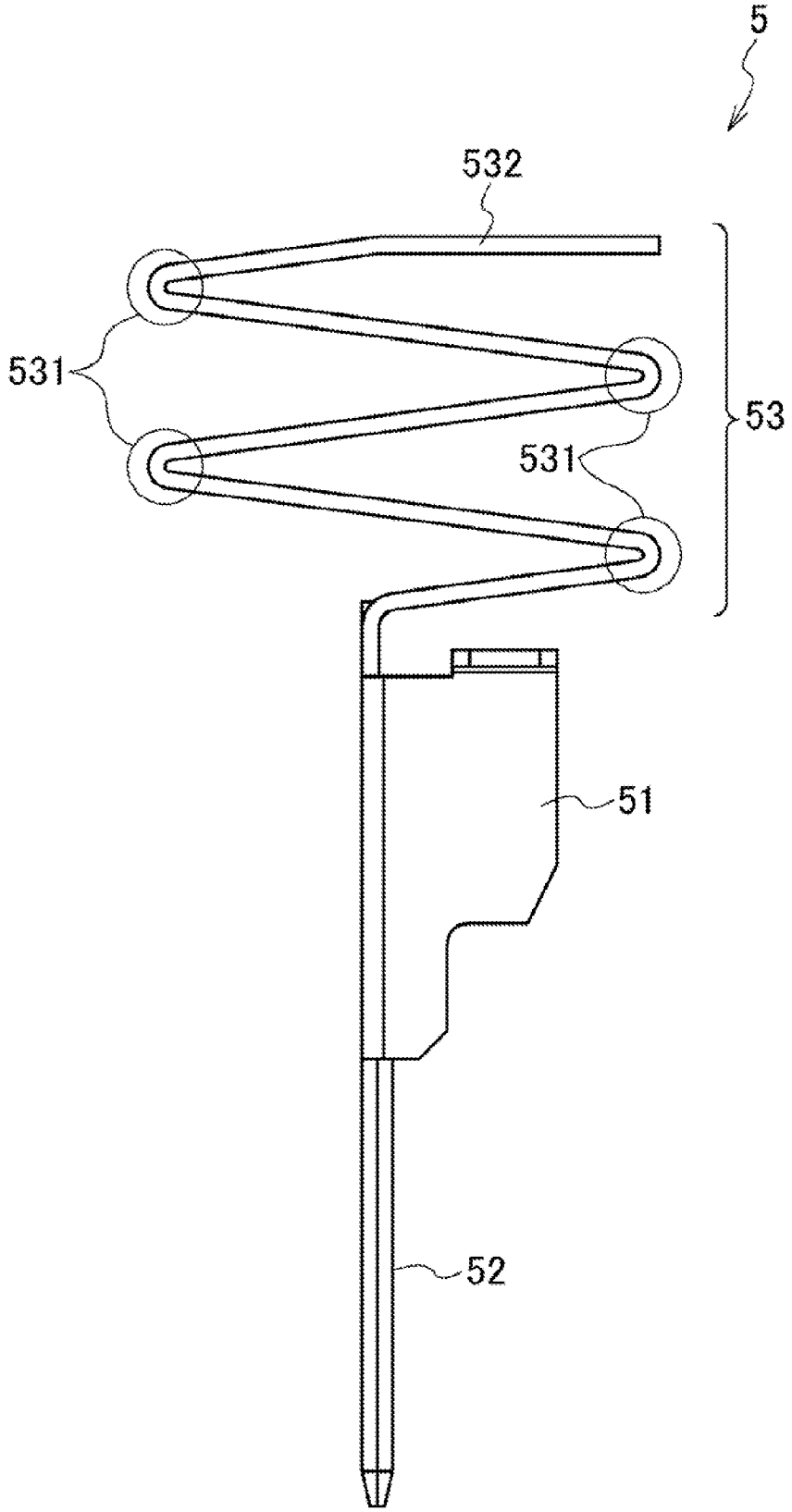
FIG. 2 is a side view showing a terminal fitting of FIG. 1.
Figure 3:
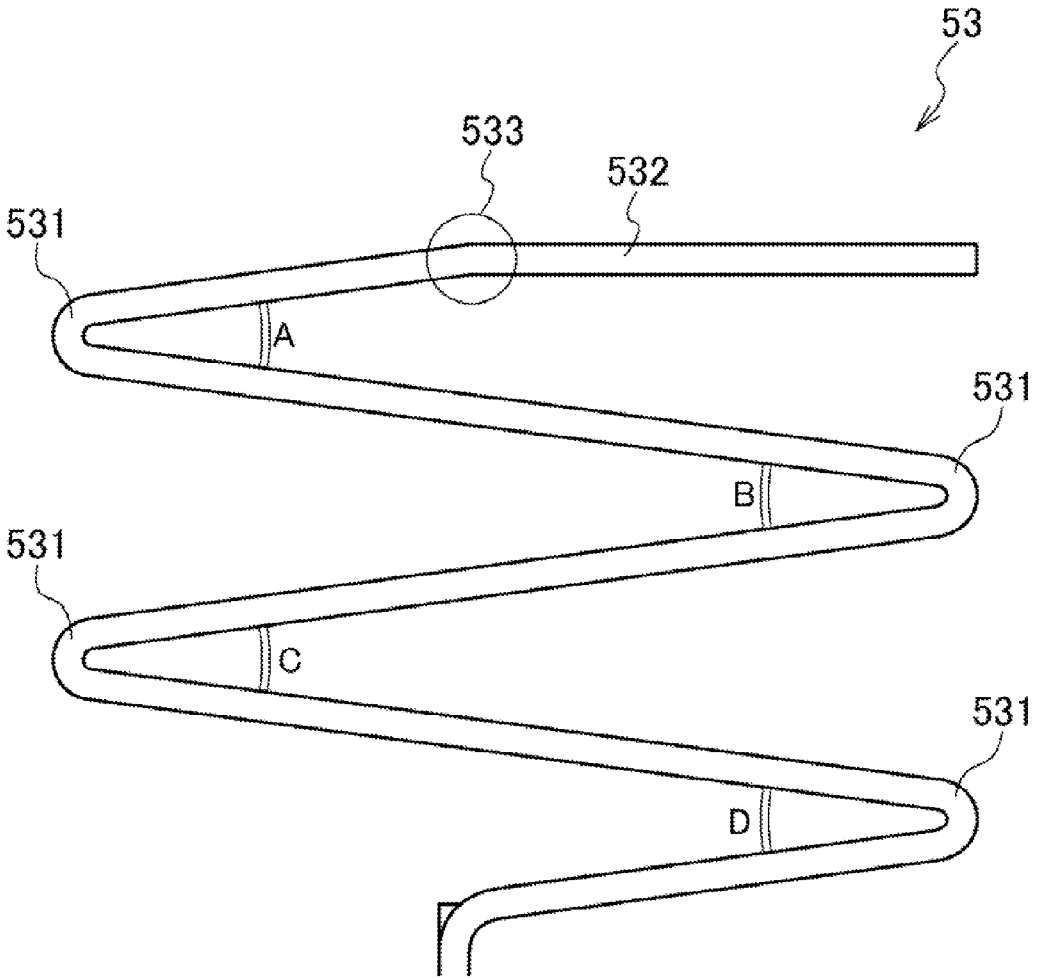
FIG. 3 is a partially enlarged view of the terminal fitting of FIG. 2.

Each of the terminal fittings 5 includes a body 51, a leg part 52 linearly extending from one end of the body 51, and a spring part 53 extending from the other end of the body 51 in a meandering shape as shown in FIG. 2. The spring part 53 includes four bent parts 531. As enlarged and shown in FIG. 3, bending angles A to D of the bent parts 531 are equal.

The distal end of the spring part 53 has a contact part 532 for making contact with the contact point 21 of the bulb 2. The contact part 532 is provided with a folded part 533 formed by folding the side of the bent part 531 beyond a portion making contact with the contact point 21 so that the contact part 532 makes perpendicular contact with the contact point 21.

Figure 4A:
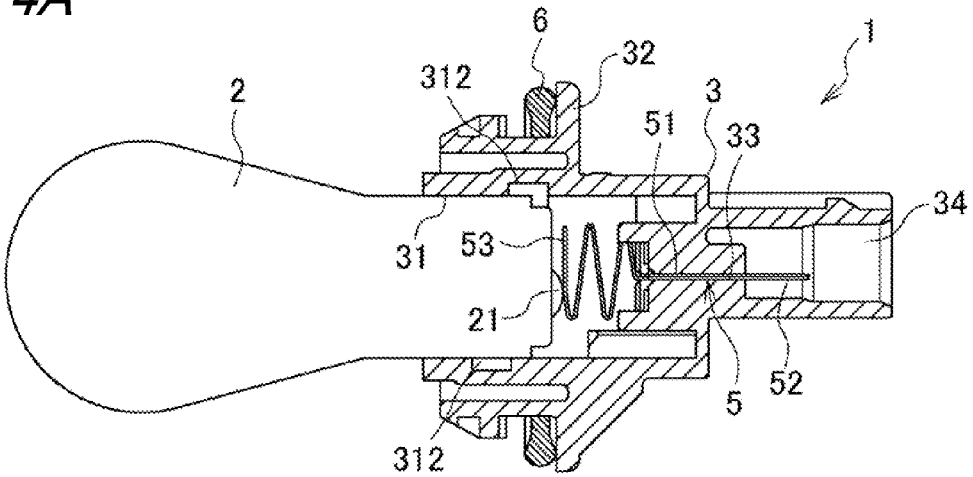
FIGS. 4A to 4C are diagrams showing operation in the case of mounting a bulb in the bulb socket.
Figure 4B:
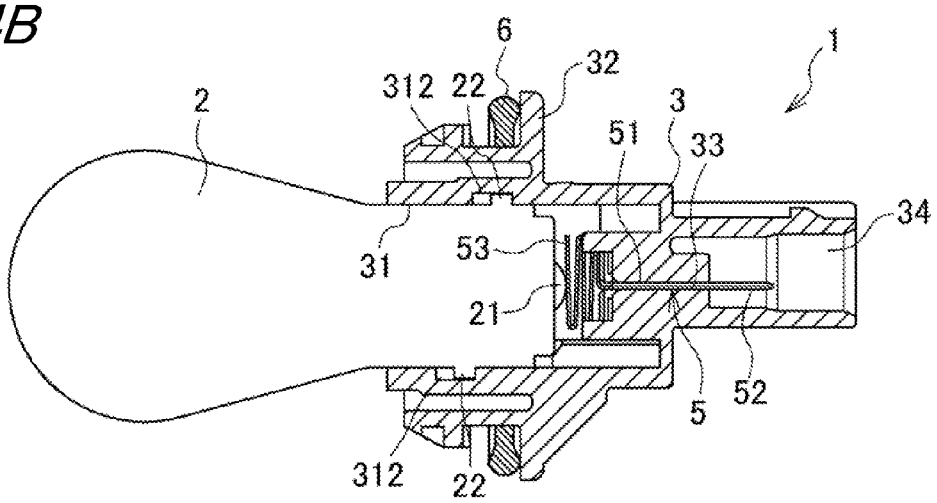
Figure 4C:
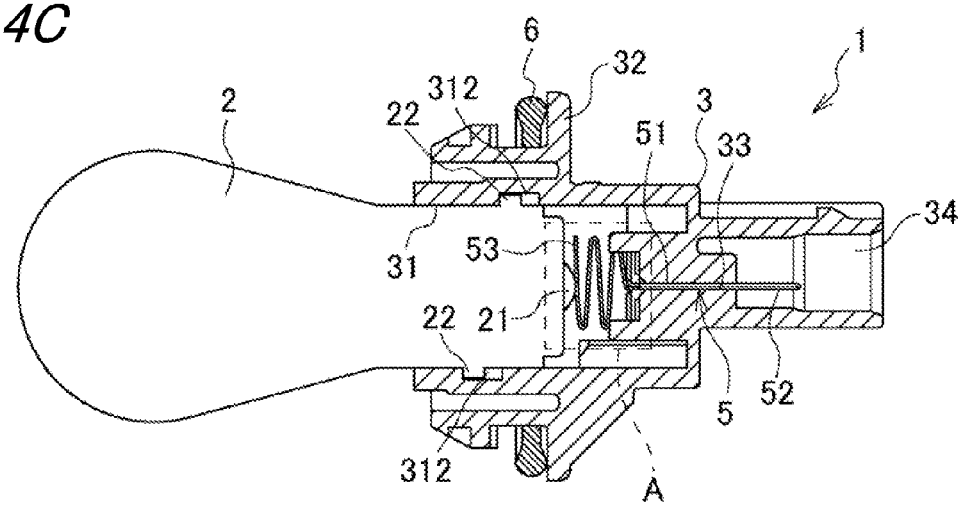

In the terminal fitting 5, the body 51 is fitted into the insertion hole 33 of the socket body 3 and the leg part 52 is inserted into the insertion hole 33 and the distal side of the leg part 52 is projected inside the connection 34 as shown in FIGS. 4A to 4C. The spring part 53 of the terminal fitting 5 is arranged inside the mounting port 31 and the contact part 532 is turned to the opening end side of the mounting port 31.

Next, operation of the bulb socket 1 in the case of mounting the bulb 2 inside the mounting port 31 of the socket body 3 will be described.

The bulb 2 is straight moved inside the mounting port 31 with the protrusion 22 guided into the guide groove 311 of the socket body 3 as shown in FIG. 4A. When the contact point 21 of the bulb 2 abuts on the contact part 532, each of the spring parts 53 of the terminal fittings 5 is pressed to the side of the body 51 by the contact point 21, and contracts with the amount of bending of the bent parts 531 increased as shown in FIG. 4B.

Figure 5:
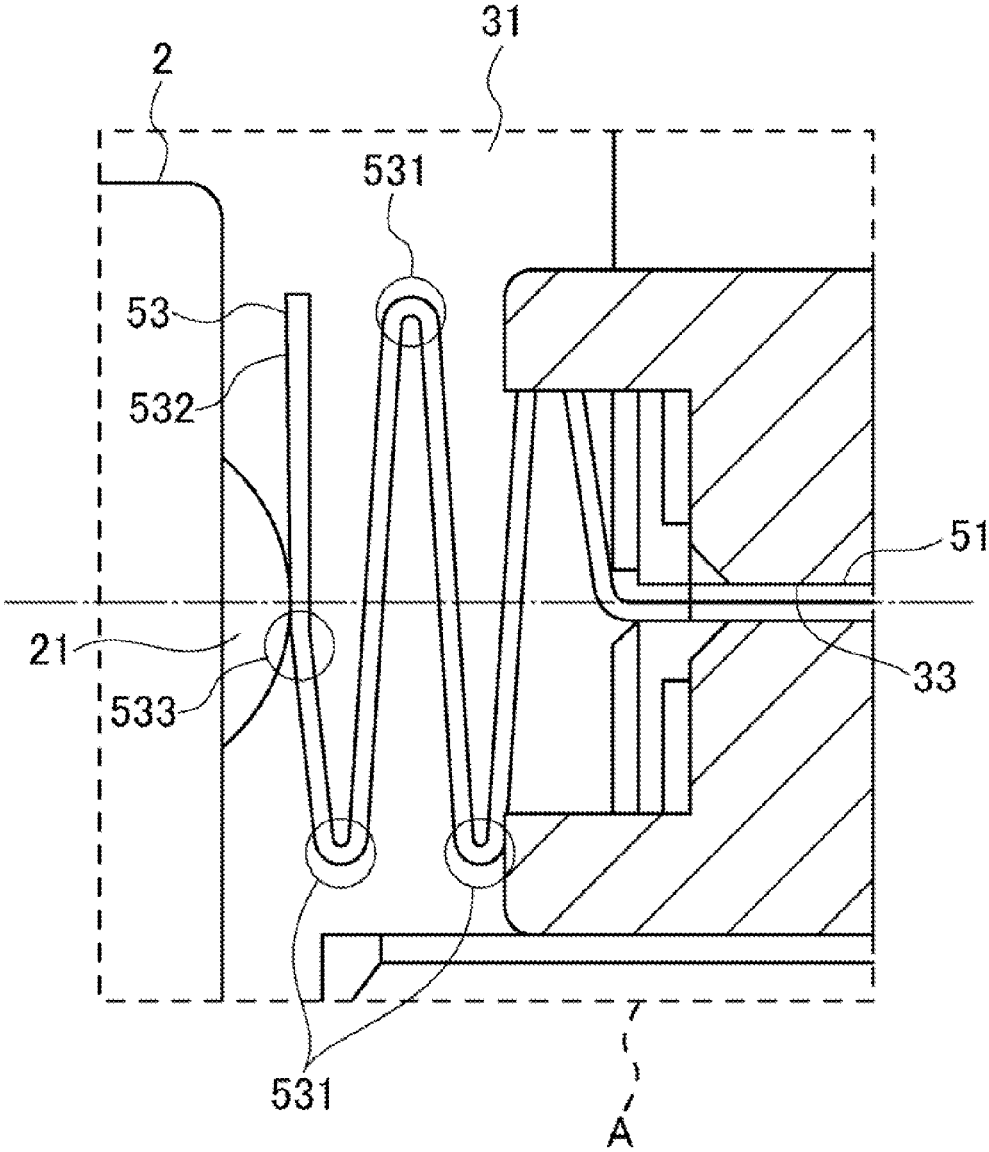
FIG. 5 is a diagram showing a spring part making elastic contact with a terminal of the bulb in FIG. 4.
Figure 6A:
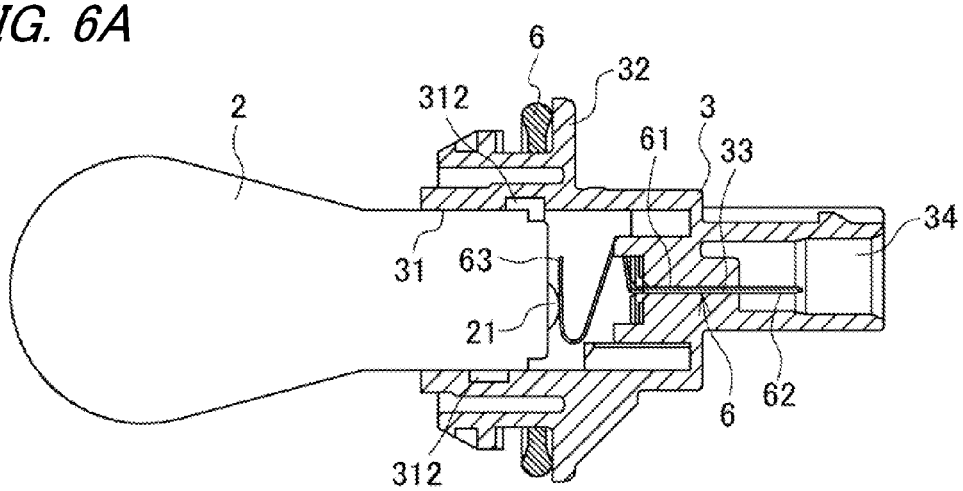
FIGS. 6A to 6C are diagrams showing operation in the case of mounting a bulb in a conventional bulb socket.
Figure 6B:
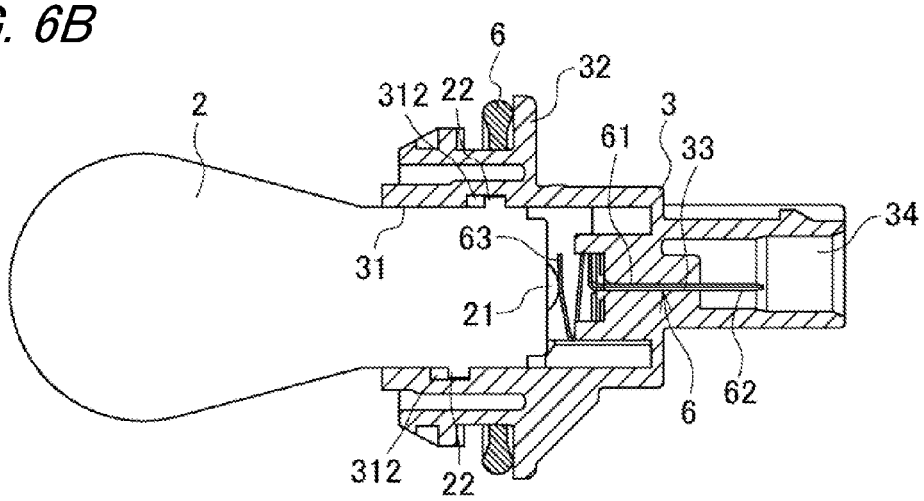
Figure 6C:
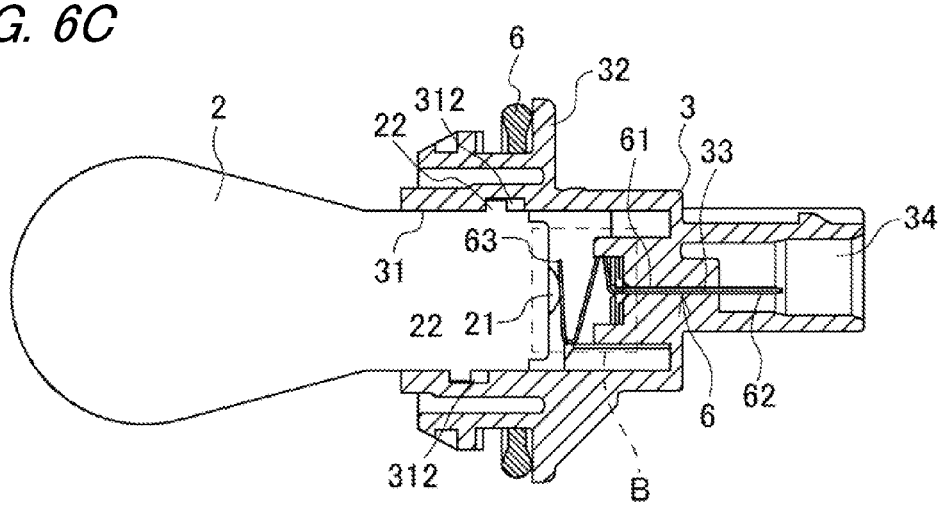
Figure 7:
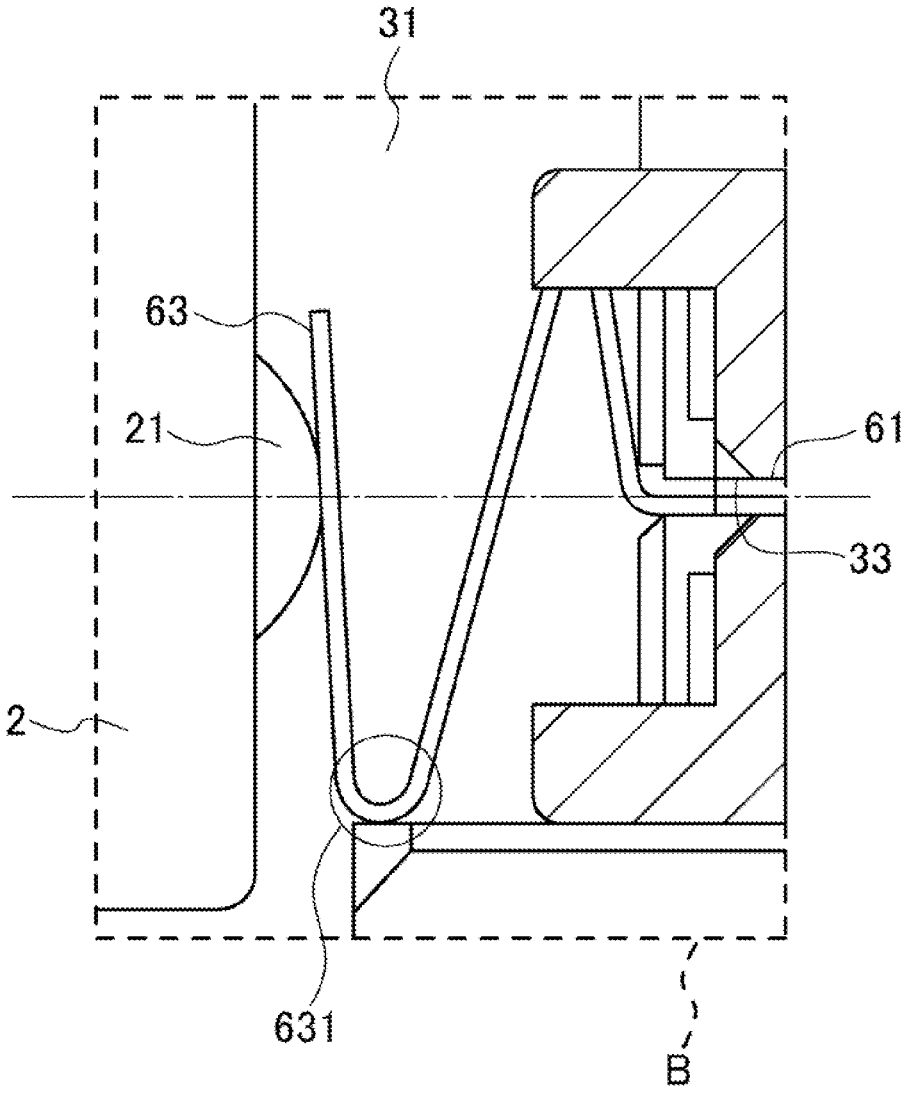
FIG. 7 is a diagram showing a spring part making elastic contact with a terminal of the bulb in FIG. 6.

Thereafter, as shown in FIG. 4C, when the bulb 2 is rotated and the protrusion 22 enters the inside of the lock groove 312 from the guide groove 311 and a force by which the bulb 2 is pushed into the mounting port 31 is released, the bulb 2 is moved to the opening side of the mounting port 31 by a resilient force of the spring part 53 and the protrusion 22 abuts on an inner wall of the lock groove 312 and the bulb 2 is positioned inside the lock groove 312. Each of the terminal fittings 5 brings the contact part 532 of the spring part 53 into elastic contact with the contact point 21 of the bulb 2, and makes electrical connection between the bulb 2 and the connector connected to the connection 34 as shown in FIG. 5.

According to the embodiment, the spring part 53 formed in the meandering shape includes the four bent parts 531, so that as compared with a conventional case shown in FIGS. 6A to 6C and 7, the amount of deformation of each of the bent parts

531 is decreased to reduce settling and spring performance of the spring part 53 can be prevented from being degraded with use.

Also, each of the bent parts 531 is bent at an equal angle, so that the amount of deformation of each of the bent parts 531 is prevented from varying to reduce settling effectively and degradation in the spring performance can be prevented more effectively.

Also, the contact part 532 is folded and the contact part 532 makes perpendicular contact with the contact point 21, so that displacement of a position of contact between the spring part 53 and the contact point 21 of the bulb 2 is reduced and continuity performance can be improved.

In addition, in the embodiment described above, the case where the spring part 53 includes the four bent parts 531 has been described, but the number of bent parts 531 is freely selected as long as the number is four or more. Also, in the embodiment described above, the case where the bending angle of each of the bent parts 531 of the spring part 53 is equal has been described, but the bending angle may differ every the bent part 531. Also, in the embodiment described above, the case where the contact part 532 includes the folded part 533 has been described, but the folded part 533 may not necessarily be included.

It is apparent that various modifications can be made in the invention within a scope not deviating from the gist of the invention.

The present application is based on Japanese patent application No. 2012-026869 filed on Feb. 10, 2012, and the contents of the patent application are incorporated herein by reference.

According to the invention, the spring part formed in the meandering shape includes the at least four bent parts, so that the amount of deformation of each of the bent parts is decreased to reduce settling and spring performance of the spring part can be prevented from being degraded with use. Also, the side of the bent part beyond the portion making contact between the contact point and the contact part is folded and the contact part makes perpendicular contact with the contact point, so that displacement of a position of contact between the spring part and the contact point is reduced and continuity performance can be improved.

What is claimed is:

1. A terminal fitting which is attached to a bulb socket and makes elastic contact with a contact point of a bulb mounted in the bulb socket, including a spring part for making elastic contact with the contact point, wherein the spring part is formed in a meandering shape including at least four bent parts and extending from a contact part making contact with the contact point, and wherein the contact part includes a leg having an obtuse angle portion between a contact segment of the leg that contacts the contact point and a bent part closest to the contact segment, such that the contact segment makes perpendicular contact with the contact point.

2. The terminal fitting as claimed in claim 1, wherein each of the bent parts is bent at an equal angle.

3. The terminal fitting as claimed in claim 1, wherein the obtuse angle portion is formed by folding a side of the leg.

4. A bulb socket including a terminal fitting as claimed in claim 1.

* * * * *